US006309752B1

(12) United States Patent
Dams et al.

(10) Patent No.: US 6,309,752 B1
(45) **Date of Patent: *Oct. 30, 2001**

(54) SUBSTRATE HAVING HIGH INITIAL WATER REPELLENCY AND A LAUNDRY DURABLE WATER REPELLENCY

(75) Inventors: Rudolf J. Dams, Zwijndrecht; Johan E. DeWitte, Westmalle; Christoffel C. Maes, Ekeren, all of (BE)

(73) Assignee: 3M Innovative Properties Company, St. Paul, MN (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/231,028

(22) Filed: Jan. 14, 1999

Related U.S. Application Data

(63) Continuation-in-part of application No. 08/868,267, filed on Jun. 3, 1997, now abandoned, which is a continuation-in-part of application No. 08/699,140, filed on Aug. 16, 1996, now abandoned, which is a continuation of application No. 07/679,558, filed on Apr. 2, 1991, now abandoned.

(51) Int. Cl.[7] ..... B32B 27/12; C08F 14/18; C08F 18/20

(52) U.S. Cl. ..... 428/421; 428/392; 428/394; 428/424.2; 428/424.6; 428/475.8; 428/483; 428/522; 428/537.5; 442/85; 442/91; 524/589; 524/599; 525/124; 525/129; 526/242; 526/245; 526/248; 526/310

(58) Field of Search ..... 428/421, 392, 428/394, 424.2, 424.6, 475.8, 483, 522, 537.5; 442/85, 91; 524/589, 599; 525/124, 129; 526/242, 245, 248, 310

(56) References Cited

U.S. PATENT DOCUMENTS

| | | | |
|---|---|---|---|
| 2,803,615 | | 8/1957 | Ahlbrecht et al. . |
| 2,934,450 | | 4/1960 | Brown et al. . |
| 3,068,187 | | 12/1962 | Bolstad et al. . |
| 3,094,547 | | 6/1963 | Heine et al. . |
| 3,329,661 | | 7/1967 | Smith et al. . |
| 3,341,497 | | 9/1967 | Sherman et al. . |
| 3,398,182 | | 8/1968 | Guenthner et al. . |
| 3,458,571 | | 7/1969 | Tokoli et al. . |
| 3,462,296 | | 8/1969 | Raynolds et al. . |
| 3,574,791 | | 4/1971 | Sherman et al. . |
| 3,595,944 | | 7/1971 | Manning et al. . |
| 3,728,151 | | 4/1973 | Sherman et al. . |
| 3,736,177 | | 5/1973 | Buchan et al. . |
| 3,849,521 | | 11/1974 | Kirimoto et al. . |
| 3,896,251 | | 7/1975 | Landucci . |
| 3,916,053 | | 10/1975 | Sherman et al. . |
| 3,949,124 | | 4/1976 | Jilia . |
| 4,013,627 | | 3/1977 | Temple . |
| 4,024,178 | | 5/1977 | Landucci . |
| 4,029,585 | | 6/1977 | Dettre et al. . |
| 4,034,964 | | 7/1977 | Larson . |
| 4,144,367 | | 3/1979 | Landucci . |
| 4,160,777 | | 7/1979 | Loudas . |
| 4,165,338 | | 8/1979 | Katsushima et al. . |
| 4,190,545 | | 2/1980 | Marshall et al. . |
| 4,215,205 | | 7/1980 | Landucci . |
| 4,264,484 | | 4/1981 | Patel . |
| 4,325,857 | | 4/1982 | Champaneria et al. . |
| 4,340,749 | | 7/1982 | Patel . |
| 4,388,372 | | 6/1983 | Champaneria et al. . |
| 4,401,780 | | 8/1983 | Steel . |
| 4,426,476 | | 1/1984 | Chang . |
| 4,525,305 | | 6/1985 | Patel . |
| 4,525,423 | | 6/1985 | Lynn et al. . |
| 4,529,658 | | 7/1985 | Schwartz et al. . |
| 4,540,497 | | 9/1985 | Chang et al. . |
| 4,560,487 | | 12/1985 | Brinkley . |
| 4,564,366 | | 1/1986 | Patel . |
| 4,565,641 | | 1/1986 | Chang et al. . |
| 4,566,981 | | 1/1986 | Howells . |
| 4,579,924 | | 4/1986 | Schwartz et al. . |
| 4,582,882 | | 4/1986 | Lynn et al. . |
| 4,606,737 | | 8/1986 | Stern . |
| 4,668,406 | | 5/1987 | Chang . |
| 4,668,726 | | 5/1987 | Howells . |
| 4,743,470 | * | 5/1988 | Nachtkamp et al. . |
| 4,834,764 | | 5/1989 | Deiner et al. . |
| 5,047,065 | | 9/1991 | Vogel et al. . |
| 5,057,577 | * | 10/1991 | Matsuo et al. . |
| 5,276,175 | | 1/1994 | Dams et al. . |

FOREIGN PATENT DOCUMENTS

| | | | |
|---|---|---|---|
| 0 429 983 | | 5/1991 | (EP) . |
| 0 646 196 | | 7/1996 | (EP) . |
| 54-145387 | * | 11/1979 | (JP) . |
| 56-165072 | * | 5/1980 | (JP) . |
| 59-230083 | * | 6/1983 | (JP) . |
| 61-019684 | * | 1/1986 | (JP) . |
| 61-218700 | * | 9/1986 | (JP) . |
| 02-209984 | * | 2/1989 | (JP) . |
| 2-002795 | * | 1/1990 | (JP) . |
| WO 92/17636 | | 10/1992 | (WO) . |

* cited by examiner

*Primary Examiner*—Robert Dawson
*Assistant Examiner*—Jeffrey B. Robertson

(57) ABSTRACT

Compositions comprising a fluorochemical agent, a copolymer extender, and a blocked isocyanate extender and substrates treated with such compositions that possess high initial water repellency and laundry durable water repellency.

12 Claims, No Drawings

SUBSTRATE HAVING HIGH INITIAL WATER REPELLENCY AND A LAUNDRY DURABLE WATER REPELLENCY

CROSS-REFERENCE TO RELATED APPLICATIONS

This application is a continuation-in-part application of U.S. application Ser. No. 08/868,267, filed Jun. 3, 1997, (now abandoned), which is a continuation-in-part application of U.S. application Ser. No. 08/699,140, filed Aug. 16, 1996 (now abandoned), which is a continuation application of U.S. application Ser. No. 07/679,558, filed Apr. 2, 1991 (now abandoned).

BACKGROUND OF THE INVENTION

This invention relates to aqueous compositions containing fluorochemical oil- and water-repellent agents. This invention also relates to agents that improve fluorine efficiency of fluorochemical oil- and water-repellent agents. This invention also relates to processes for providing oil- and water-repellency to fibrous substrate materials.

DESCRIPTION OF THE RELATED ART

Water-, oil- and soil-repellent finishes containing fluorochemical agents or compositions are well known. A considerable disadvantage of such finishes, however, is their high price. So-called "extenders" have therefore been developed in order to reduce cost. Modified synthetic resins, waxes, paraffin emulsions, and similar products have been used for this purpose.

U.S. Pat. No. 3,849,521 (Kirimoto et al.) describes oil- and water-repellent compositions containing a polymer containing fluoroalkyl-containing monomer units and an additive copolymer containing monomer units having the formula $$CR_1R_2{=}CR_3R_4$$

wherein $R_1$, $R_2$ and $R_3$ represents hydrogen atoms or methyl groups, and $R_4$ represents a $C_{1-18}$ alkyl group; and monomer units having the formula:

$$CH_2{=}CR_5CONHCH_2OH$$

wherein $R_5$ represents a hydrogen atom or a methyl group

U.S. Pat. No. 4,834,764 (Deiner et al.) describes the use of blocked isocyanate compounds as extenders, the isocyanate compound before blocking being diphenylmethane diisocyanate or an isocyanate compound having a molecular weight of at least 450.

SUMMARY OF THE INVENTION

This invention provides fluorine-efficient oil- and water-repellent compositions comprising:

(A) a fluorochemical oil-and water-repellent agent;

(B) a copolymer extender comprising:

(i) polymerized units derived from a monomer of Formula V:

$$CR_1R_2{=}CR_3R_4 \qquad \text{(V)}$$

wherein each of $R_1$, $R_2$, $R_3$ and $R_4$ independently represents hydrogen, halogen, or an organic group such as alkyl, carboxyl, or acyloxyalkyl (i.e., —$CO_2$alkyl); and (ii) polymerized units derived from a monomer of Formula VII:

$$CH_2{=}CR_5X \qquad \text{(VII)}$$

wherein $R_5$ represents a hydrogen atom or a methyl group, and X represents a moiety comprising a functional group that can interact with a fibrous substrate; and (C) a blocked isocyanate extender.

This invention also provides substrates treated with a fluorine-efficient composition as described above, and methods of improving the fluorine-efficiency of a fluorochemical oil- and water-repellent agent, comprising the step of formulating the fluorochemical agent with components (B) and (C) described above.

The compositions of the invention comprise at least one member of each of two classes of extenders. The combination improves the fluorine-efficiency of fluorochemical agents, and thus reduces the cost of fluorochemical treatment, to a greater extent than would be expected based on the properties of each individual class of extenders.

DETAILED DESCRIPTION OF THE INVENTION

Component (A) in a composition of the invention is a fluorochemical oil- and water-repellent agent generally comprising a plurality of fluoroaliphatic (i.e., $R_f$) groups. Such agents are well known to those skilled in the art, and many (e.g., SCOTCHGARD™ fabric protector, Minnesota Mining and Manufacturing Company) are commercially available as ready-made formulations.

In general, fluorochemical agents useful in this invention comprise fluorochemical compounds or polymers containing one or more fluoroaliphatic groups $R_f$, which are fluorinated, stable, inert, non-polar, preferably saturated, monovalent and both oleophobic and hydrophobic. $R_f$ preferably contains at least about 3 carbon atoms, more preferably 3 to about 20 carbon atoms, and most preferably about 6 to about 14 carbon atoms. $R_f$ can contain straight chain, branched chain, or cyclic fluorinated alkylene groups or combinations thereof or combinations thereof with straight chain, branched chain, or cyclic alkylene groups. $R_f$ is preferably free of polymerizable olefinic unsaturation and can optionally contain catenary heteroatoms such as oxygen, divalent or hexavalent sulfur, or nitrogen. It is preferred that $R_f$ contain about 40% to about 78% fluorine by weight, more preferably about 50% to about 78% fluorine by weight. The terminal portion of the $R_f$ group contains a fully fluorinated terminal group. This terminal group preferably contains at least 7 fluorine atoms, e.g., $CF_3CF_2CF_2$—, $(CF_3)_2CF$—, —$CF_2SF_5$, or the like. Perfluorinated aliphatic groups (i.e., those of the formula $C_nF_{2n+1}$) are the most preferred embodiments of $R_f$.

Examples of fluorochemical agents include, for example, $R_f$-containing urethanes, ureas, esters, amines (and salts thereof), amides, acids (and salts thereof), carbodiimides, guanidines, allophanates, biurets, and compounds containing two or more of these groups, as well as mixtures and blends thereof.

Useful fluorochemical polymers containing $R_f$ groups include copolymers of fluorochemical acrylate and/or methacrylate monomers with the following co-polymerizable monomers including fluorine-containing and fluorine-free hydrophobic monomers such as methyl methacrylate, butyl acrylate, octadecylmethacrylate, acrylate and methacrylate esters of poly)oxyalkylene) polyol oligomers and polymers, e.g., poly(oxyethylene)glycol dimethacrylate, glycidyl methacrylate, ethylene, vinyl acetate, vinyl chloride, vinylidene chloride, vinylidene fluoride, acrylonitrile, vinylchloroacetate, isoprene, chloroprene, styrene, butadiene, vinylpyridine, vinyl alkyl ethers, vinyl alkyl ketones, acrylic and methacrylic acid, 2-hydroxyethyl acrylate, N-methylolacrylamide; 2-(N,N,N-trimethylammonium)ethyl methacrylate and the like.

Particular fluorochemical agents include those described in Pat. Nos. 2,803,615 (Ahlbrecht et al.), 2,934,450 (Brown), 3,068,187 (Bolstad et al.), 3,094,547 (Heine), 3,329,661 (Smith et al.), 3,341,497 (Sherman et al.), 3,398,182 (Guenthner et al.), 3,458,571 (Tokoli), 3,462,296 (Raynolds et al.), 3,574,791 (Sherman et al.), 3,728,151 (Sherman et al.), 3,896,251 (Landucci), 3,916,053 (Sherman et al.), 4,013,627 (Temple), 4,024,178 (Landucci), 4,029,585 (Dettre), 4,034,964 (Sherman et al.), 4,144,367 (Landucci), 4,160,777 (Loudas), 4,165,338 (Katsushima et al.), 4,190,545 (Marshall), 4,215,205 (Landucci), 4,264,484 (Patel), 4,325,857 (Champaneria et al.), 4,340,749 (Patel), 4,401,780 (Steel), 4,426,476 (Chang), 4,525,305 (Patel), 4,525,423 (Lynn et al.), 4,529,658 (Schwartz et al.), 4,540,497 (Chang et al.), 4,560,487 (Brinkley), 4,564,366 (Patel), 4,565,641 (Chang et al.), 4,566,981 (Howells), 4,579,924 (Schwartz et al.), 4,582,882 (Lynn et al.), 4,606,737 (Stern), 4,668,406 (Chang), 4,668,726 (Howells), 5,276,175 (Dams), each of which is incorporated herein by reference.

Particularly useful compositions impart high initial water repellency and laundry durable water repellency to treated substrates. High initial water repellency can be indicated by initial Water Spray Test Ratings of a treated substrate of about 90%. "High laundry durability" in the context of this invention means that the treated substrate has at least a 10% higher Water Spray Test Rating after 5 launderings (performed according to the Laundering Procedure described herein) than the same type of substrate treated with (a) a composition containing the fluorochemical agent alone, or (b) a composition containing the fluorochemical agent and copolymer extender alone, or (c) a composition containing the fluorochemical agent and the blocked isocyanate extender alone after five launderings. The particularly useful compositions can be prepared using fluorochemical agents selected from the group consisting of: $R_f$-containing carbodiimides, $R_f$-containing melamines; $R_f$-containing polyisocyanates with one or more blocked isocyanate groups; and copolymers of fluorochemical acrylates, and/or methacrylates with copolymerizable fluorine-containing monomers, and/or hydrophobic, fluorine-free monomers. Examples of suitable hydrophobic, fluorine-free monomers include: methyl methacrylate, butyl acrylate, octadecylmethacrylate, glycidyl methacrylate, ethylene, vinyl acetate, vinyl chloride, vinylidene chloride, acrylonitrile vinyl chloroacetate, isoprene, chloroprene, styrene butadiene, vinylpyridine, vinyl alkyl ethers, vinyl alkyl ketones and N-methylacrylamide. An example of a suitable fluorinated co-monomer is vinylidene fluoride. The $R_f$-containing polyisocyanates with one or more blocked isocyanate group will have at least one, but not all, of the isocyanate groups on its polyisocyanate precursor reacted with an isocyanate group blocking agent that is removable from the polyisocyanate under thermal conditions, such as those employed during the cure of a substrate treated with a compound containing the $R_f$-containing polyisocyanate. Conventional isocyanate blocking agents useful in preparing the $F_f$-containing polyisocyanate with one or more blocked isocyanate groups includes: arylalcohols (e.g., phenol, cresols, nitrophenols, o- and p-chlorophenol, naphthols, 4-hydroxybiphenyl), $C_2$ to $C_8$ alkanone oximes (e.g., acetone oxime, butanone oxime); arylthiols (e.g., thiophenol); organic, active-hydrogen compounds (e.g., diethyl malonate, acetylacetone, ethyl acetoacetate, ethyl cyanoacetate, ε-caprolactam), sodium bisulfite, and hydroxylamine. Particularly preferred blocking agents include $C_2$ to $C_8$ alkanone oximes, particularly butanone oxime. Blends or mixtures of these fluorochemical agents may also be used in the particularly useful compositions. Particular examples of fluorochemical agents useful in the particularly preferred compositions include the materials described in U.S. Pat. Nos. 3,98,182 (Guenthner et al.) and 5,276,175 (Dams) ($R_f$-containing polyisocyanates with one or more blocked isocyanate groups); 4,024,178 (Landucci), 3,896,251 (Landucci) and 4,215,205 (Landucci) ($R_f$-containing carbodiimides); 2,803,615 (Albrecht et al.), 3,329,661 (Smith et al.) and 3,341,497 (Sherman et al.) (fluorinated copolymers); and 4,834,764 (Deiner et al.) ($R_f$-containing melamine resins. See col. 2, lines 7 to 12)

Component (B) in a composition of the invention is a copolymer extender comprising:

(i) polymerized units derived from a monomer of Formula V:

$$CR_1R_2{=}CR_3R_4 \qquad (V)$$

wherein each of $R_1$, $R_2$, $R_3$, and $R_4$ independently represents hydrogen, halogen, or an organic group; and (ii) polymerized units derived from a monomer of Formula VII:

$$CH_2{=}CR_5X \qquad (VII)$$

wherein $R_5$ is hydrogen or methyl and X is a moiety comprising a function group that can interact with a fibrous substrate.

Examples of monomers of Formula V include general classes of ethylenic compounds capable of free-radical polymerization, such as lower olefinic hydrocarbons, optionally halogenated, such as ethylene, propylene, isobutene, 3-chloro-2-isobutene, butadiene, isoprene, chloro and dichlorobutadienes, fluoro and difluorobutadienes, 2,5-dimethyl-1,5-hexadiene; vinyl, allyl or vinylidene halides such as vinyl or vinylidene chloride, vinyl or vinylidene fluoride, allyl bromide, allyl chloride, methallyl chloride; styrene and its derivatives such as vinyltoluene, α-methylstyrene, α-cyanomethylstyrene, divinylbenzene, N-vinylcarbazole; vinyl esters such as vinyl acetate, vinyl propionate, vinyl isobutyrate, vinyl succinate, vinyl stearate, divinylcarbonate; allyl esters such as allyl acetate and allyl heptanoate; alkylvinyl or alkylallyl ethers such as cetyl vinyl ether, dodecyl vinyl ether, isobutyl vinyl ether, ethyl vinyl ether, 2-chloroethyl vinyl ether, tetrallyloxyethane; vinyl alkyl ketones such as vinyl methyl ketone; unsaturated acids such as acrylic, α-chloro acrylic, α-fluoro acrylic, crotonic, maleic, fumaric, itaconic, and citraconic acids, and anhydrides and esters thereof such as dimethyl maleate, ethyl crotonate, acid methyl maleate, acid butyl itaconate, and vinyl, allyl, methyl, ethyl, butyl, isobutyl, hexyl, 2-ethylhexyl, chlorohexyl, octyl, lauryl, or stearyl acrylates and methacrylates; olefinic silanes such as vinyltrichlorosilane, vinyltrimethoxysilane, vinyltriethoxysilane, and methacryloyloxypropyl trimethoxysilane; nitriles such as acrylonitrile, methacrylonitrile 2-chloroacrylonitrile, 2-cyanoethylacrylate, methylene glutaronitrile, vinylidene cyanide, alkyl cyanoacrylates such as isopropyl cyanoacrylate; (tris)-acryloyl-hexahydro-s-triazine; special acrylates such as butanediol dimethacrylate, dicyclopentenyl acrylate, ethoxylated bisphenol A dimethacrylate, isobornyl acrylate and methacrylate, trimethylopropane triacrylate, allyl methacrylate; acrylamides and methacrylamides; mono- or di-(meth)acrylates of glycols or polyalkylene glycols such as ethylene glycol dimethacrylate, triethylene glycol acrylate, mono, di, and polyacrylates and methacrylates of methoxypolyethylene glycols and polyethylene glycols of various molecular weights (available as CARBOWAX™), block copolymers of ethylene oxide and propylene oxide endcapped by hydroxy groups (available as PLURONIC™), tetramethyleneoxide glycols (available as TERATHANE™), amino or diamino-terminated polyethers (available as JEFFAMINE™); mono-, di-, and polyacrylates and methacrylates of siloxane mono-, di-, or polyols such as 1,3-bis(4-hydroxybutyl)tetramethyl disiloxane (Petrarch Systems, Bristol, Pa.); VP-1610 siloxane diol (Wacker—Germany); Q4-3667 siloxane diol (Dow Corning): Q4-3557 siloxane diol (Dow Corning); acrylamides and methacrylamides of siloxane mono, di or polyamines such as 1,3-bis(y-aminopropyl)tetramethyl disiloxane (Petrarch Systems); DC-531 siloxane polyamine (Dow Corning); DC-536 siloxane polyamine (Dow Corning); and others described in U.S. Pat. NO. 4,728,571 (Clemens et al.), the disclosure of which is incorporated herein by reference.

A particularly preferred class of monomers of Formula V is acrylate monomers of Formula IX $$CR_6R_7{=}CR_8COOR_9 \quad \text{(IX)}$$

wherein $R_6$, $R_7$, and $R_8$ independently represent a hydrogen atom or a methyl group, and $R_9$ represents a $C_{1-18}$ alkyl group.

Preferred among this class are alkyl crotonates, alkyl acrylates and alkyl methacrylates such as methyl acrylate, methyl methacrylate, propyl acrylate, propyl methacrylate, butyl acrylate, butyl methacrylate, isoamyl acrylate, isoamyl methacrylate, 2-ethylhexyl acrylate, 2-ethylhexyl methacrylate, octyl methacrylate, lauryl acrylate, lauryl methacrylate, cetyl acrylate, or cetyl methacrylate.

The copolymer extender also comprises polymerized units derived from a monomer of Formula VII. Suitable monomers of Formula VII include those comprising a functional group that can interact with a fibrous substrate by, for example, physical entanglement, covalent bonding by way of nucleophilic, electrophilic, ionic, free radical or like reactions between the copolymer and the substrate, or ionic bonding. Wool, leather, paper, cotton, and nylon variously comprise hydroxyl, amino, carboxyl, and carboxamido groups. For the purposes of the instant specification and claims, "a functional group that can interact with a fibrous substrate" designates a group that can interact with a fabric by any of the above-described mechanisms. Such groups can be easily selected by those skilled in the art as a function of the particular fibrous substrate that is intended to be treated with the composition of the invention. Representative groups suitable for interacting with a substrate include polymerizable olefin, olefin that can undergo a hydrosilation reaction, epoxy, amino, hydroxy, halo, haloformyl, aziridino, acid groups such as carboxy, sulfo, sulfino, sulfeno, dihydroxyphosphinyl, and hydroxyphosphinilidene, alkali metal and alkaline-earth metal salts thereof, amine salts thereof, quaternary ammonium salts thereof and the like, or amino and quaternary ammonium groups and salts thereof with, e.g., the above-listed types of acids.

Examples of suitable functionalized monomers include N-methylol acrylamide; N-methylol methacrylamide; aziridinyl acrylate and methacrylate; diacetone acrylamide and methacrylamide; methylolated diacetone acrylamide and methacrylamide; 2-hydroxy-3-chloropropyl acrylate and methacrylate; hydroxy ($C_2$ to $C_4$) alkyl acrylates and methacrylates; maleic anhydride; butadiene; isoprene; chloroprene; allyl alcohol; allyl glycolate; isobutenediol; allyloxyethanol; o-allyl phenol; divinyl carbinol; glycerol α-allylether, acrylamide; methacrylamide; maleamide; maleimide; N-cryanoethyl acrylamide; N-isopropyl acrylamide; glyoxal bis-acrylamide; metal salts of acrylic acid and methacrylic acid; vinylsulfonic and styrene p-sulfonic acids and their metal salts; monoalkylamine; vinylpyridines; N-vinylpyrrolidone; 2-acrylamido-2-methylpropanesulfonic acid (AMPS) and its salts; vinyl azlactones; glycidyl acrylate and methacrylate; allyl glycidyl ether; acrolein; N,N-dimethylaminoethyl acrylate and methacrylate; N-tert-butylaminoethyl methacrylate; allyl methacrylate; diallyl maleate; vinyltriethoxysilane; vinyltrichlorosilane; and the like.

Preferred functionalized monomers of Formula VII include those of Formula XI:

$$CH_2{=}CR_5CONHCH_2OH \quad \text{(XI)}$$

wherein $R_5$ represents a hydrogen atom or a methyl group. Copolymers comprising such monomers are described in U.S. Pat. No. 3,849,521 (Kirimoto et al.) incorporated herein by reference. Other suitable copolymers can be prepared by methods well known to those skilled in the art.

Component (C) in a composition of this invention is a blocked isocyanate. Suitable isocyanates for use (before blocking) include aromatic diisocyanates such as 4,4'-methylenediphenylene diisocyanate, 4,6-di-(trifluoromethyl)-1,3-benzene diisocyanate, 2,4-toluene diisocyanate, 2,6-toluene diisocyanate, o, m, and p-xylylene diisocyanate, 4,4-diisocyanatodiphenylether, 3,3'-dichloro-4,4'-diisocyanatodiphenylmethane, 4,5'-diphenyl diisocyanate, 4,4'-diisocyanatodibenzyl, 3,3,-dimethoxy-4,4,-diisocyanatodiphenyl, 3,3'-dimethyl-4,4'-diisocyanatodiphenyl, 2,2,-dichloro-5,5,-dimethoxy-4,4'-diisocyanato diphenyl, 1,3-diisocyanatobenzene, 1,2-naphthylene diisocyanate, 4-chloro-1,2-naphthylene diisocyanate, 1,3-naphthylene diisocyanate, and 1,8-dinitro-2,7-naphthylene diisocyanate; alicyclic diisocyanates such as 3-isocyanatomethyl-3,5,5-trimethylcyclohexylisocyanate; aliphatic diisocyanates such as methylenediisocyanate, 1,6-hexamethylene diisocyanate, 2,2,4-trimethyl-1,6-hexamethylene diisocyanate, and 1,2-ethylene diisocyanate; aliphatic triisocyanates such as 1,3,6-hexamethylene triisocyanate; aromatic polyiisocyanates such as polymethylene polyphenylisocyanate (PAPI); and cyclic diisocyanates such as isophorone diisocyanate (IPDI).

Also useful are isocyanates containing internal isocyanate-derived moieties such as biuret-containing tri-isocyanates such as that available from Mobay as DESMODUR™ N-100, isocyanurate-containing tri-isocyanates such as that available from Huls AG, Germany, as IPDI-1890, and azetedinedione-containing diisocyanates such as that available from Bayer as DESMODUR™TT. Also, triisocyanates such as tri-(4-isocyanatophenyl)-methane (available from Bayer as DESMODUR™R) are suitable.

Another suitable class of isocyanates is isocyanate-functional low molecular weight polyurethanes. These polyurethanes are prepared by reacting a polyfunctional, aliphatic, cycloaliphatic, araliphatic or aromatic polyisocyanate, such as, for example, hexamethylene-1,6-diisocyanate, the various isomers of toluene diisocyanate, diphenylmethane diisocyanate, isophorone diisocyanate and the like, with a low molecular weight polyol having at least 2, preferably at least 3 hydroxyl groups. Suitable low molecular weight polyols include trimethylolpropane, 1,3,5-hexanetriol, glycerol, penetaerythritol, propylene glycol, hexylene glycol and diethylene glycol. Also suitable are other low molecular weight polyhydroxy compounds, such as triethanolamine.

These low molecular weight polyurethanes can be prepared by reacting a polyol with an excess of polyisocyanate. The equivalent ratio of hydroxyl to isocyanato groups in the reaction is preferably at least 1:1.3, more preferably 1:1.5 to 2.5.

The above-described isocyanates are used in a composition of the invention in the form of "blocked isocyanates", i.e., the reaction product of an isocyanate and a blocking agent, wherein the blocking agent is removable from the isocyanate under thermal conditions such as those employed during cure of a substrate treated with a compound containing the blocked isocyanato group. Conventional isocyanate blocking agents include arylalcohols (e.g., phenol, cresols, nitrophenols, o- and p-chlorophenol, naphthols, 4-hydroxybiphenyl); $C_2$ to $C_8$ alkanone oximes (e.g. acetone oxime, butanone oxime); arylthiols (e.g., thiophenol); organic active hydrogen compounds (e.g.; diethyl malonate, acetylacetone, ethyl cyanoacetate, ethyl cyanoacetate, ϵ-caprolactam); sodium bisulfite; and hydroxylamine. Particularly preferred blocked isocyanates include those blocked with $C_2$ to $C_8$ alkanone oximes, particularly butanone oxime. Such blocked isocyanates can be de-blocked at a relatively low temperature, for example during the process of curing a substrate that has been treated with the composition comprising the blocked isocyanate.

Some of the above-described blocked isocyanates are disclosed in U.S. Pat. No. 4,834,764 (Deiner et al.) the disclosure of which is incorporated herein by reference. Others can be prepared by methods well known to those skilled in the art.

A composition of the invention comprises the fluorochemical agent in an amount effective to impact repellent properties ot a fibrous substrate treated with the composition. The amount of fluorochemical agent that constitutes an effective amount can be easily determined by those skilled in the art and depends on the particular fluorochemical agent used and on the amounts of the copolymer and blocked isocyanate extenders used.

The copolymer extender and the blocked isocyanate extender are present in a combined amount effective to improve the fluorine efficiency of the fluorochemical agent. Each extender is preferably present in an amount such that the improvement in fluorine efficiency is greater than the improvement provided by either extender alone.

"Improvement in fluorine efficiency" as used herein designates an improvement in the repellent properties imparted by a fluorochemical agent per unit weight of fluorine in a composition comprising the agent, as those repellent properties are measured using the test procedures set forth below. Stated another way, an extender (or combination of extenders) improves the fluorine efficiency of a given fluorochemical agent if performance is improved by including the extender(s) in a composition containing the same or a lesser concentration of the fluorochemical agent.

Generally, the extenders are present in relative amounts between about 1:20 to about 20:1, preferably about 1:4 to about 4:1, more preferably about 2:1 to about 1:2, and most preferably about 1:1. Generally, the fluorochemical agent is present in an amount of about 20 to about 2000, preferably 40 to about 900, and most preferably about 100 to about 400, parts by weight based on 100 parts by weight of the copolymer and the blocked isocyanate extenders combined.

When a composition of the invention is applied as a treatment to a fibrous substrate, e.g., a fabric intended for use in a garment, it is preferred that a treated substrate comprise the fluorochemical agent in an amount of about 0.1% to about 0.6% by weight based on the weight of the untreated substrate. Further, it is preferred that a treated substrate comprise the fluorochemical agent, the copolymer extender, and the blocked isocyanate extender in a total combined amount of about 0.1% to about 1% by weight based on the weight of the untreated substrate. The particularly useful, initially high-water-repellent, laundry-durable-water-repellent compositions are applied to fibrous substrates at low levels to take advantage of the economic benefits that can be provided by the compositions. At such levels, the synergy of the compositions is best demonstrated. Accordingly, it is preferred that the treated substrate comprises the fluorochemical agent, the copolymer extender and the blocked isocyanate extender in a total combined amount of about 0.1% to 0.4% by weight based on the weight of the untreated substrate.

Knowing the amount of composition intended to be incorporated on the substrate, the percent pick-up of the substrate, and the mass of the substrate, a composition of the invention can be applied to a substrate by any suitable method. For example, a composition can be prepared in the form of an aqueous dispersion and the substrate treated therewith. A dispersion will generally contain water, an amount of composition effective to provide repellent properties to a substrate treated therewith, and an emulsifier in an amount effective to stabilize the dispersion. Water is preferably present in an amount of about 70 to about 900 parts by weight based on 100 parts by weight of the composition of the invention. The emulsifier is preferably present in an amount of about 1 to about 25 parts by weight, preferably about 5 to about 10 parts by weight, based on 100 parts by weight of the composition of the invention. Conventional cationic, nonionic, anionic, and zwitterionic emulsifiers are suitable.

In order to effect treatment of a substrate, the substrate can be immersed in the dispersion and agitated until it is saturated. The saturated substrate can then be run through a padder/roller to remove excess dispersion, dried an oven at a relatively low temperature (e.g., 70° C.) for a time sufficient to remove the dispersion medium (e.g., water, ethylene glycol, or a mixture thereof), and cured at a temperature and for a time sufficient to provide a cured treated substrate. This curing process can be carried out at temperatures between 40° C. and about 200° C. depending on the particular composition used. In general, a temperature of about 155° C. for period of about 5 minutes is suitable. The cured treated substrate can be cooled to room temperature and used as desired, e.g., incorporated or fashioned into a garment such as rainwear.

In order to improve fixing of a fluorinated compound of the invention to a substrate, it is sometimes advantageous to include in the dispersion certain additives, polymers, thermo-condensable products and catalysts capable of promoting interaction with the substrate. Among these are the condensates or precondensates of urea or melamine with formaldehyde (sometimes referred to herein as resins).

Other auxiliary extenders can be used, either alone or in combination with each other. Suitable auxiliary extenders include paraffin; compositions containing alkylketenes or derivatives thereof; siloxanes; chlorohydrates of stearamidomethylpyridinium; condensates of fatty acids with melamine or urea derivatives (such as the product obtained on reacting stearic acid with hexamethoxymethylmelamine), condensates of fatty acids with polyamides (such as the reaction product of stearic acid with diethylenetriamine) and their epichlorohydrin adducts. It is also possible to use salts of inorganic or organic acids such as aluminum stearate, zirconium acetate, zirconium oxychloride or Werner complexes such as chromium stearatochloride.

If it is desired to improve the softness or "hand" of a substrate treated with a composition of the invention, it is possible to use softeners, such as certain polyethylenes, polydimethylsiloxanes, modified hydrogenalkylpolysiloxanes, or other materials known to those skilled in the art.

In combination with compositions of this invention it is also possible to use auxiliary products such as polyglycols, colloids such as starch, dextrin, casein, sizing agents, fixing or retaining agents, materials to improve stain resistance, cleaning ability, fire proofing or antistatic properties, buffering agents, fungicidal agents, optical bleaching agents, sequestering agents, mineral salts, surface-activity agents, or swelling agents to promote penetration. Particular suitable auxiliary products and amounts thereof can be easily selected by those skilled in the art.

In addition to providing oil- and water-repellent properties to substrates, the compositions of the invention can also be used to provide anti-adhesion properties and to protect substrates against solvents or certain aggressive chemicals. They can also be used for applications such as stain resistance, soil resistance, soil release and stain release on textiles, paper, or leather. Further, they can be used for imparting properties such as antistatic, antipilling, mold release, corrosion inhibition, or anti-fouling properties.

Substrates treated with compositions of the invention were tested by the test methods set forth below.

Water Spray Test (SR)

The resistance of a treated substrate to wetting with water was measured using AATCC Test Method 22-1977, "Water Repellency: Spray Test" as described in American Association of Textile Chemists and Colorists Technical Manual, 1977, 53, 245. Samples are rated on a scale of 0 to 100, with 0 indicating complete wetting of the upper and lower surfaces of the substrate and 100 indicating no wetting.

Oil Repellency Test (OR)

The oil repellency of a substrate treated with a compound of the invention was measured using AATCC Test Method 118-1975, "Oil Repellency: Hydrocarbon Resistance Test" as described in AATCC Technical Manual, 1977, 53, 223. This test measures the resistance of a substrate to wetting by a series of hydrocarbon liquids with a range of surface tensions. The values reported range from 0 (least repellent) to 8 (most repellent).

Laundering Procedure

The procedure set forth below was used to prepare treated substrate samples designated in the examples below as "5×Laundered" or "5 Laund".

A 230 g sample of generally square, 400 $cm^2$ to about 900 $cm^2$ sheets of treated substrate was place din a washing machine along with a ballast sample (1.9 Kg of 8 oz fabric in the form of generally square, hemmed 8100 $cm^2$ sheets). Conventional detergent ("TIDE", 46 g) is added and the washer is filled to high water level with hot water (49° C.±3° C.). The substrate and ballast load is washed five times using a 12-minute normal wash cycle and the substrate and the ballast are dried together in a conventional clothes dryer set on the "heat" setting for about 45 minutes. The dry substrate is pressed using a hand iron set at the temperature recommended for the particular substrate fabric.

Dry Cleaning Procedure

Substrate samples designated in the examples below as "Dry Cleaned" were treated as set forth in AATCC Test Method 7-1975, note 8.1

The following describes the preparation of extenders and fluorochemical agents used in the Examples that follow. Also described below are several commercially available fluorochemical agents that are used in the Examples.

Water Repellency Test

Treated textile samples were evaluated for water repellency using 3M Water Repellency Test V for Floorcoverings (February 1994), available from Minnesota Mining and Manufacturing Company. In this test, treated textile samples are challenged to penetrations by blends of deionized water and isopropyl alcohol (IPA). Each blend is assigned a rating number as shown below:

| Water Repellency Rating Number | Water/IPA Blend (% by volume) |
|---|---|
| F | (fails water) |
| 0 | 100% water |
| 1 | 90/10 water/IPA |
| 2 | 80/20 water/IPA |
| 3 | 70/30 water/IPA |
| 4 | 60/40 water/IPA |
| 5 | 50/50 water/IPA |
| 6 | 40/60 water/IPA |
| 7 | 30/70 water/IPA |
| 8 | 20/80 water/IPA |
| 9 | 10/90 water/IPA |
| 10 | 100% IPA |

In running the Water Repellency Test, a treated textile sample is placed on a flat, horizontal surface. Five small drops of water on a water/IPA mixture are gently placed at points at least two inches apart on the textile sample. If, after observing for ten seconds at a 45° angle, four of the five drops are visible as a sphere or a hemisphere, the textile is deemed to pass the test. The reported water repellency rating corresponds to the highest numbered water or water/IPA mixture for which the treated textile sample passes the described test.

Intermediate A

2-Butanone oxime (26.1 g, 0.3 mol, available from Servo Company, the Netherlands, as SERVOXIME™ Y-250) was added at room temperature over about 30 minutes to PAPI (40.8 g, 0.3 equivalents, a polyphenylpolyisocyanate, Upjohn, equivalent weight 136 with a chemical structure

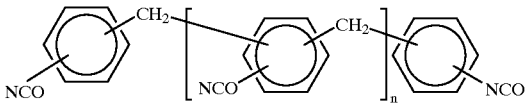

wherein average n = 0.7)

The reaction temperature was increased to 60° C. and maintained for two hours. The reaction mixture was then diluted to 40% solids in ethyl acetate using about 86 g ethyl acetate. A clear, brown organic solution was obtained.

In a separate flask was placed MARLOWET™ 5401 cationic emulsifier (5.7 g, 10 percent by weight based on total solids, Hüls, Germany), ethylene glycol (35 g, 60% by weight on total solids) and deionized water (171 g, 300% by weight on total solids). This solution was warmed to about 40° C. and under very vigorous mixing added to the organic solution, also at about 40° C. A milky pre-emulsion was obtained, which was passed three times through a MANTON-GAULIN™ emulsifier at about 40° C. and 300 bar pressure. The solvent was removed under reduced pressure. A slightly brown dispersion was obtained. This dispersion was diluted to 20% solids and filtered and stored.

Intermediate A2

Intermediate A2 was prepared using essentially the same procedure as for preparing Intermediate A except that 0.3 equivalents of DESMODUR™ N-100 (an aliphatic triisocyanate derived from hexamethylene diisocyanate and available from Mobay Corp., Pittsburgh, Pa.) was substituted for 0.3 equivalents of PAPI.

Intermediate A3

Intermediate A3 was prepared using essentially the same procedure as for preparing Intermediate A except that 0.3 equivalents of toluene diisocyanate was substituted for 0.3 equivalents of PAPI.

Intermediate A4

Intermediate A4 was prepared using essentially the same procedure as for preparing Intermediate A except that 0.3 equivalents of isophorone diisocyanate was substituted for 0.3 equivalents of PAPI.

Intermediate B

2-Ethylhexyl methacrylate (59,4 g, 0.3 mol), N-methylolacrylamide (1.5 g, 0.014 mol), ETHOQUAD™ 18/25 cationic emulsifier (Akzo, the Netherlands, 3 g, about 5% by weight on total solids), tertiary dodecyl mercaptan (0.15 g, about 0.25% by weight on total solids) and V-50™ initiator ([2,2'-azobis[2-methylpropanimidamide]-dihydrochloride, Wako, Japan]0.12 g, about 0.2% by weight on total solids) and deionized water (140 g) were mixed. The mixture was deaereated and then heated at 75° C. for 16 hours. A nearly transparent dispersion was obtained.

Intermediate B2

Intermediate B2 was prepared using essentially the same procedure as for preparing Intermediate B except that 0.3 mol of isobutyl methacrylate was substituted for 0.3 mol of 2-ethylhexyl methacrylate prior to the polymerization.

Intermediate B3

Intermediate B3 was prepared using essentially the same procedure as for preparing Intermediate B except that 0.3 mol of octadecyl methacrylate was substituted for 0.3 mol of 2-ethylhexyl methacrylate prior to the polymerization.

Intermediate B4

Intermediate B4 was prepared using essentially the same procedure as for preparing Intermediate B except that 0.3 mol of n-butyl acrylate was substituted for 0.3 mol of 2-ethylhexyl methacrylate prior to the polymerization.

Intermediate C

A dispersion was prepared as described in U.S. Pat. No. 3,068,187 (Bolstad et al., Example 5), containing a graft copolymer of a fluorinated monomer and a fluorine-free comonomer.

Intermediates D and E

A mixture of N-ethyl perfluorooctylsulfonamidoethanol (EtFOSE, 40.8 g, 0.3 equivalents) dry ethyl acetate (100 g) and 4 drops of dibutyltindilaurate was heated at reflux (about 78° C.) for 4 hours. 2-Ethylhexanol (13 g, 0.1 mol) was then added and the reaction was continued at reflux for another 6 hours. A clear, brown solution was obtained. The reaction product was emulsified following the procedure describe din Intermediate A above. A slightly brown dispersion was obtained, which was further diluted with water to 20% solids filtered, and stored.

Using the same synthetic procedure and emulsification method, Intermediate E was prepared. PAPI (40.8 g, 0.3 equivalent), N-methylperfluorooctylsulfonamidoethanol (44.7 g, 0.1 equivalent), and 2-butanone oxime (17.4 g, 0.2 mol) were reacted to obtain a fluorochemical urethane composition containing blocked isocyanate groups.

Intermediate F

LODYNE™ 921 C (149 g, 0.24 mol, a telomer mercaptan represented by the formula $C_nF_{2n+1}CH_2CH_2SH$ where n=6, 8, 10, 12, 14 . . . average n is about 10, available from Ciba-Geigy), 2-butyl-1,4-diol (11 g, 0.13 mol) and hexafluoroxylene (100 g) were combined. The mixture was warmed to 62° C. and a solution of VAZO™ 52 initiator [(2,2'-azobis-(2,4-dimethylvaleronitrile), 5 g, Du Pont)] in 10 g of dichloromethane was added over a period of 4 hours. The reaction was continued for 4 hours at 70° C. A hazy, slightly yellow reaction mixture was formed. Dry ethyl acetate (100 g) and trimethylhexamethylenediisocyanate (22 g, 0.1 mol, TMDI, Bayer) were added and the reaction mixture was heated to 80° C. Dibutyltin dilaureate catalyst (0.2 g) was added. The reaction was continued for 8 hours at 95° C. DDI (51 g, 0.08 mol, dimer diisocyanate, Henkel) and methyldiethanolamine (6 g, 0.05 mol) were added. The reaction was continued at 90° C. for 4 hours. A clear, brown solution was obtained. To 200 g of the solution, 101 g butyl acetate, 3.5 g acetic acid and 87 g ethylene glycol were added. The resulting organic solution was warmed to 75° C.

In a separate flask a solution of 5.2 g MARLOWET™ 5401 surfactant (about 5% by weight on total solids) in 463 g deionized water was heated to 75° C. Under vigorous stirring, this aqueous solution was added to the organic solution. The pre-emulsion obtained was passed 5 times through a preheated MANTON-GAULIN™ emulsifier at about 70 to 75° C. and 300 bar pressure. A microemulsion was obtained. All solvents were removed (at 50° C. and about 5 mm Hg vacuum) slightly brown dispersion was filtered and stored.

Intermediate G

N-Methylperfluorooctylsulfonamidoethyl acrylate, (61.1 g, 0.1 mol), 2-mercaptoethanol (1.95 g, 0.025 mol), ethyl acetate 40 g and AIBN (0.12 g, 0.2% by weight on total solids) were mixed, deaerated, and heated at reflux (about 80° C.) for 16 hours. The reaction mixture was cooled to room temperature. PAPI (10.2 g, 0.075 equivalent) was added together with 2 drops of dibutyltin dilaureate catalyst. The reaction mixture was heated at reflux for 5 hours. The reaction was then cooled to about 60° C. and 4.35 g of 2-butanone oxime (0.05 mol) was added. The reaction was continued for 2 hours at 70° C. The reaction product was emulsified at 70° C. using the procedure described in Intermediate A. A slightly brown dispersion was obtained, filtered, and stored.

Intermediate H

FC-217, a fluorochemical acrylate copolymer commercially available from Minnesota Mining and Manufacturing Company.

Intermediate I

FC-352, a fluorochemical carbodiimide containing composition commercially available from Minnesota Mining and Manufacturing Company.

Intermediate J

FC-353, a fluorochemical containing ester commercially available from Minnesota Mining and Manufacturing Company.

Intermediate K

N-Allylperfluorooctylsulfonamide (54 g, 0.1 equivalent), a polymethylhydrogensiloxane (12 g, 0.2 equivalents BAYSILONE-L™ MH15 silicone, Bayer, of the formula $(CH_3)_3SiO[(CH_3)(H)SiO]_nSi(CH_3)_3$ wherein n=40) and butyl acetate (60 g) were combined. Them mixture was heated to 110° C. and 1 mL of 1% solution of $H_2Pt_{116}$ in 2-butanone is added. After 30 minutes Monylvinylester (2 g, 0.01 mol, VEORA™ 10, Shell) and 0.3 mL of the 1% catalyst solution was added. The reaction was heated at 126° C. for 1 hour. A slightly brown solution was obtained. The material was emulsified at 30° C. using the procedure, ingredients, and amounts described in Intermediate H. A slightly brown dispersion was obtained, the pH was adjusted to 7, and the emulsifion was filtered and stored.

Intermediate L

FC-247, a composition containing a blend of a fluorochemical ester, a fluorochemical urethane, and a fluorochemical acrylate copolymer, commercially available from Minnesota Mining and Manufacturing Company.

Intermediate M

FC-214, a composition containing a blend of a fluorochemical urethane and a fluorochemical copolymer, and commercially available from Minnesota Mining and Manufacturing Company.

Intermediate N

FC-270, a composition containing a blend of a fluorochemical carbodiimide and a fluorochemical acrylate copolymer, commercially available from Minnesota Mining and Manufacturing Company.

Intermediate O

Into a polymerization bottle was placed N-methyl perfluorooctylsulfonamidoethyl acrylate (30.6 g, about 0.050 mol, MeFOSEA), 2-ethylhexyl acrylate (8.1, about 0.044 mol) 2-hydroxyethyl acrylate (0.7 g, about 0.006 mol), 2 g ETHOQUAD™ 18/25 emulsifier (Akzo, The Netherlands), tertiary dodecylmercaptan (0.2 g, 0.5% by weight on total monomers), V-50™ initiator (2,2'-azobis[2-methylpropanimidamide], 0.08 g, Wako, Japan), acetone (15 g) and deionized water (78 g). The reaction mixture was deaerated and the polymerization bottle was capped and put into a launderometer at 70° C. for 16 hours. The resulting nearly transparent dispersion was filtered and stored.

Intermediate P

Following the procedure of Intermediate O, MeFOSEA, octadecyl methacrylate, and polydimethylsiloxane monomethacrylate (molecular weight of about 2000) in a molar ratio 80 to 15 to 5 were reacted. A nearly transparent dispersion was obtained.

Intermediate Q

Hexamethoxymethylmelamine (39 g, 0.1 mol, CYMEL™ 303, American Cyanamid), a fluorochemical mercaptan with general formula $C_nF_{2n+1}CH_2CH_2SH$ (232 g, 0.4 mol, average n is about 10, average molecular weight is about 580, Atochem, France) and para-toluenesulfonic acid (0.42 g) were mixed and heated at 90° C. Methanol was evolved and removed by distillation. Over a 2 hour period the temperature was further raised to 180° C. and kept at that temperature for 4 hours. After cooling to about 80° C., hexafluoroxylene solvent was added to make a 40% solids solution (in total, 348 g hexafluoroxylene was used). A dispersion was prepared of this solution according to the procedure set forth in Intermediate F. The dispersion was filtered and stored.

Intermediate R

Polyethylene wax, available from Henkel Corp. as Adalin™ K.

Intermediate S

Metal oxide extender, available from Catomance Corp. as Mystolene™ MK-9.

Intermediate T

Fatty acid modified methylolmelamine, available from Pfersee Chemie as Phobotex™ FTC.

Intermediate U

Polysiloxane, available from Pfersee Chemie as Phoboton™ AFN.

The above Intermediates were tested, according to the test methods mentioned above, by themselves and in combination with one extender or a combination of two extenders. Formulations were prepared and fabrics treated according to the general procedure set forth below:

Formulation and Treatment Procedure

A fluorochemical agent as described in Intermediates C-Q above is provided and formulated into a treatment bath containing a predetermined amount of each of the appropriate fluorochemical agent, the copolymer extender, and the blocked isocyanate extender such that the treatment can be made by a padding application at the indicated percent solids on fabric. After treatment, the substrate is dried and cured at 150° C. for 10 min.

Objects and advantages of this invention are further illustrated by the following examples. The particular materials and amounts thereof recited in these examples, as well as other conditions and details, should not be construed to unduly limit this invention.

EXAMPLES 1–7 AND COMPARATIVES EXAMPLES C-1 TO C-52

Fluorochemical agents were formulated with single extenders and combinations of extenders to treat a polyester/cotton 50/50 fabric at 0.4% total solids on fabric.

Results are shown in Table I below, wherein FC designates fluorochemical agent and weight percents indicate percent based on the combined weight of the fluorochemical agent and the extender or extenders.

TABLE I

| | | Weight % Extender 1 | Weight % Extender 2 | Initial | | | 5 Laund. | | 1 Dry Clean | |
|---|---|---|---|---|---|---|---|---|---|---|
| Ex. | % FC | (Int) B | (Int) A | OR | SR | WR | OR | SR | OR | SR |
| | | | Fluorochemical: Intermediate C | | | | | | | |
| C-1 | 100 | — | — | 5 | 90 | 1 | 3 | 60 | 4 | 80 |
| C-2 | 80 | 20 | — | 5 | 100 | 2 | 4 | 80 | 5 | 80 |
| C-3 | 80 | — | 20 | 5 | 100 | 2 | 3 | 80 | 5 | 80 |
| 1 | 80 | 10 | 10 | 5 | 100 | 3 | 4 | 90 | 5 | 80 |
| 2 | 70 | 20 | 10 | 5 | 100 | 2 | 4 | 90 | 5 | 80 |
| | | | Fluorochemical: Intermediate D | | | | | | | |
| C-4 | 100 | — | — | 5 | 90 | 2 | 3 | 50 | 0 | 0 |
| C-5 | 80 | 20 | — | 6 | 90 | 2 | 5 | 80 | 0 | 0 |

TABLE I-continued

| Ex. | % FC | Weight % Extender 1 (Int) B | Weight % Extender 2 (Int) A | Initial OR | Initial SR | Initial WR | 5 Laund. OR | 5 Laund. SR | 1 Dry Clean OR | 1 Dry Clean SR |
|---|---|---|---|---|---|---|---|---|---|---|
| C-6 | 80 | — | 20 | 5 | 90 | 1 | 4 | 90 | 0 | 0 |
| C-7 | 80 | 10 | 10 | 5 | 100 | 3 | 5 | 90 | 0 | 0 |
| C-8 | 70 | 20 | 10 | 5 | 100 | 3 | 5 | 90 | 0 | 0 |
| | | | Fluorochemical: Intermediate E | | | | | | | |
| C-9 | 100 | — | — | 2 | 100 | 2 | 2 | 80 | 1 | 70 |
| C-10 | 80 | 20 | — | 4 | 100 | 3 | 3 | 90 | 3 | 90 |
| C-11 | 80 | — | 20 | 2 | 100 | 2 | 3 | 90 | 2 | 90 |
| 3 | 80 | 10 | 10 | 4 | 100 | 5 | 4 | 100 | 3 | 100 |
| | | | Fluorochemical: Intermediate G | | | | | | | |
| C-12 | 100 | — | — | 5 | 100 | 2 | 5 | 80 | 5 | 90 |
| C-13 | 80 | 20 | — | 6 | 100 | 2 | 5 | 90 | 6 | 90 |
| C-14 | 80 | — | 20 | 6 | 100 | 3 | 5 | 90 | 5 | 90 |
| 4 | 80 | 10 | 10 | 6 | 100 | 5 | 5 | 100 | 6 | 100 |
| 5 | 70 | 20 | 10 | 6 | 100 | 5 | 5 | 100 | 6 | 100 |
| | | | Fluorochemical: Intermediate I | | | | | | | |
| C-15 | 100 | — | — | 3 | 80 | 0 | 2 | 70 | 0 | 0 |
| C-16 | 80 | 20 | — | 3 | 80 | 0 | 2 | 80 | 0 | 0 |
| C-17 | 80 | — | 20 | 3 | 80 | 0 | 2 | 80 | 1 | 0 |
| C-18 | 80 | 10 | 10 | 3 | 90 | 1 | 2 | 80 | 1 | 0 |
| C-19 | 70 | 20 | 10 | 3 | 90 | 1 | 2 | 80 | 1 | 0 |
| | | | Fluorochemical: Intermediate J | | | | | | | |
| C-20 | 100 | — | — | 7 | 50 | 0 | 1 | 0 | 0 | 0 |
| C-21 | 80 | 20 | — | 7 | 60 | 0 | 2 | 50 | 0 | 0 |
| C-22 | 80 | — | 20 | 7 | 60 | 0 | 3 | 50 | 0 | 0 |
| C-23 | 80 | 10 | 10 | 7 | 70 | 0 | 6 | 60 | 0 | 0 |
| C-24 | 70 | 20 | 10 | 7 | 80 | 0 | 5 | 60 | 0 | 0 |
| | | | Fluorochemical: Intermediate K | | | | | | | |
| C-25 | 100 | — | — | 4 | 100 | 2 | 4 | 80 | 3 | 50 |
| C-26 | 80 | 20 | — | 4 | 100 | 2 | 4 | 80 | 3 | 70 |
| C-27 | 80 | — | 20 | 4 | 100 | 3 | 4 | 90 | 3 | 70 |
| C-28 | 80 | 10 | 10 | 4 | 100 | 3 | 4 | 90 | 3 | 80 |
| | | | Fluorochemical: Intermediate L | | | | | | | |
| C-29 | 100 | — | — | 6 | 80 | 0 | 3 | 50 | 3 | 0 |
| C-30 | 80 | 20 | — | 6 | 80 | 0 | 4 | 60 | 3 | 60 |
| C-31 | 80 | — | 20 | 6 | 90 | 1 | 3 | 70 | 3 | 70 |
| C-32 | 80 | 10 | 10 | 6 | 90 | 2 | 4 | 70 | 4 | 70 |
| | | | Fluorochemical: Intermediate M | | | | | | | |
| C-33 | 100 | — | — | 5 | 80 | 0 | 4 | 50 | 0 | 0 |
| C-34 | 80 | 20 | — | 5 | 80 | 0 | 4 | 60 | 3 | 60 |
| C-35 | 80 | — | 20 | 5 | 90 | 1 | 4 | 60 | 3 | 60 |
| C-36 | 80 | 10 | 10 | 5 | 90 | 2 | 4 | 80 | 4 | 70 |
| C-37 | 100 | — | — | 4 | 100 | 2 | 3 | 80 | 3 | 90 |
| C-38 | 80 | 20 | — | 5 | 100 | 2 | 4 | 90 | 3 | 90 |
| C-39 | 80 | — | 20 | 5 | 100 | 2 | 4 | 90 | 4 | 90 |
| C-40 | 80 | 10 | 10 | 5 | 100 | 4 | 4 | 90 | 4 | 90 |
| | | | Fluorochemical: Intermediate O | | | | | | | |
| C-41 | 100 | — | — | 6 | 80 | 0 | 0 | 0 | 6 | 60 |
| C-42 | 80 | 20 | — | 7 | 90 | 0 | 5 | 60 | 7 | 70 |
| C-43 | 80 | — | 20 | 5 | 100 | 2 | 5 | 100 | 5 | 80 |
| C-44 | 80 | 10 | 10 | 6 | 100 | 5 | 6 | 100 | 6 | 80 |
| C-45 | 70 | 20 | 10 | 7 | 100 | 3 | 7 | 90 | 7 | 80 |
| | | | Fluorochemical: Intermediate P | | | | | | | |
| C-46 | 100 | — | — | 6 | 80 | 0 | 0 | 0 | 0 | 0 |
| C-47 | 80 | 20 | — | 6 | 80 | 0 | 4 | 70 | 4 | 80 |
| C-48 | 80 | — | 20 | 6 | 90 | 1 | 2 | 60 | 3 | 70 |
| C-49 | 80 | 10 | 10 | 6 | 90 | 1 | 5 | 80 | 5 | 90 |
| | | | Fluorochemical: Intermediate Q | | | | | | | |
| C-50 | 100 | — | — | 5 | 100 | 2 | 3 | 90 | 4 | 70 |
| C-51 | 80 | 20 | — | 6 | 100 | 3 | 4 | 90 | 4 | 80 |
| C-52 | 80 | — | 20 | 5 | 100 | 2 | 4 | 90 | 4 | 80 |
| 6 | 80 | 10 | 10 | 6 | 100 | 5 | 4 | 100 | 4 | 90 |
| 7 | 70 | 20 | 10 | 6 | 100 | 5 | 4 | 100 | 4 | 80 |

The results in Table 1 indicate that the substrates of the invention, treated with select fluorochemical agents in combination with a member of each of the two extender classes, give high initial water repellency and are superior laundry durable treatments, than the compositions of the Comparative Examples.

COMPARATIVE EXAMPLES C-53 TO C-77

As described in connection with Examples 1–7 above, formulations were prepared and used to treat 100% cotton fabrics at 0.6% total solids on fabric.

TABLE 11

| Ex. | % FC | Weight % Ext. 1 (Int) B | Weight % Ext. 2 (Int) A | Initial OR | Initial SR | 5 Laund OR | 5 Laund SR | 1 Dryclean OR | 1 Dryclean SR |
|---|---|---|---|---|---|---|---|---|---|
| Fluorochemical: Intermediate C | | | | | | | | | |
| C-53 | 100 | — | — | 4 | 80 | 3 | 70 | 4 | 70 |
| C-54 | 80 | 20 | — | 5 | 80 | 4 | 80 | 5 | 70 |
| C-55 | 80 | — | 20 | 5 | 90 | 4 | 80 | 5 | 80 |
| C-56 | 80 | 10 | 10 | 5 | 90 | 4 | 80 | 5 | 80 |
| C-57 | 70 | 20 | 10 | 5 | 100 | 3 | 80 | 5 | 80 |
| Fluorochemical: Intermediate F | | | | | | | | | |
| C-58 | 100 | — | — | 5 | 90 | 4 | 60 | 5 | 60 |
| C-59 | 80 | 20 | — | 5 | 90 | 3 | 70 | 4 | 70 |
| C-60 | 80 | — | 20 | 5 | 100 | 4 | 90 | 4 | 80 |
| C-61 | 80 | 10 | 10 | 6 | 100 | 6 | 90 | 6 | 80 |
| C-62 | 70 | 20 | 10 | 6 | 100 | 5 | 90 | 5 | 80 |
| Fluorochemical: Intermediate G | | | | | | | | | |
| C-63 | 100 | — | — | 6 | 100 | 5 | 80 | 5 | 80 |
| C-64 | 80 | 20 | — | 6 | 100 | 5 | 80 | 6 | 80 |
| C-65 | 80 | — | 20 | 6 | 100 | 5 | 90 | 5 | 90 |

TABLE 11-continued

| Ex. | % FC | Weight % Ext. 1 (Int) B | Weight % Ext. 2 (Int) A | Initial OR | Initial SR | 5 Laund OR | 5 Laund SR | 1 Dryclean OR | 1 Dryclean SR |
|---|---|---|---|---|---|---|---|---|---|
| C-66 | 80 | 10 | 10 | 6 | 100 | 5 | 90 | 6 | 90 |
| C-67 | 70 | 20 | 10 | 6 | 100 | 5 | 90 | 6 | 90 |
| Fluorochemical: Intermediate H | | | | | | | | | |
| C-68 | 100 | — | — | 4 | 70 | 0 | 0 | 4 | 0 |
| C-69 | 80 | 20 | — | 5 | 80 | 1 | 60 | 5 | 70 |
| C-70 | 80 | — | 20 | 5 | 90 | 4 | 80 | 5 | 80 |
| C-71 | 80 | 10 | 10 | 5 | 100 | 3 | 80 | 5 | 90 |
| C-72 | 70 | 20 | 10 | 5 | 100 | 4 | 80 | 5 | 90 |
| Fluorochemical: Intermediate Q | | | | | | | | | |
| C-73 | 100 | — | — | 4 | 90 | 3 | 70 | 3 | 70 |
| C-74 | 80 | 20 | — | 5 | 90 | 3 | 80 | 3 | 80 |
| C-75 | 80 | — | 20 | 4 | 100 | 3 | 90 | 3 | 80 |
| C-76 | 80 | 10 | 10 | 5 | 100 | 4 | 90 | 4 | 80 |
| C-77 | 70 | 20 | 10 | 4 | 100 | 4 | 90 | 4 | 80 |

The results in Table II show that the synergy achieved by applicant's invention is less pronounced when high levels of treatment are applied to the substrate.

EXAMPLES 8 to 10 AND COMPARATIVE EXAMPLES C-78 TO C-98

Fluorochemical Intermediates C, Comparative D and E were evaluated as treatments for polyester/cotton 50/50 (at 0.4% solids on fabric) with extender combinations both inside (Examples 8 to 10) and outside (Comparative Examples C-78 to C-98 of this invention. Results of these evaluations are presented in Table III.

TABLE III

| Ex. | Percent FC | Percent Ext. | Extender Blend (%) 1st Interm/2nd Interm. | Initial WR | Initial OR | Initial SR | 5 Laund OR | 5 Laund SR | 1 Dry Clean OR | 1 Dry Clean SR |
|---|---|---|---|---|---|---|---|---|---|---|
| Fluorochemical: Intermediate C | | | | | | | | | | |
| C-78 | 100 | — | — | 1 | 5 | 90 | 3 | 60 | 4 | 80 |
| C-79 | 80 | 20 | 100-Int. A | 2 | 5 | 100 | 3 | 80 | 5 | 80 |
| C-80 | 80 | 20 | 100-Int. B | 2 | 5 | 100 | 4 | 80 | 5 | 80 |
| 8 | 80 | 20 | 50-Int. A/50-Int. B | 3 | 5 | 100 | 4 | 90 | 5 | 90 |
| C-81 | 80 | 20 | 50-Int. A/50-Int. R | 1 | 3 | 80 | 2 | 50 | 2 | 80 |
| C-82 | 80 | 20 | 50-Int. A/50-Int. S | 1 | 4 | 90 | 2 | 70 | 2 | 80 |
| C-83 | 80 | 20 | 50-Int. A/50-Int. T | 2 | 3 | 100 | 1 | 80 | 2 | 80 |
| C-84 | 80 | 20 | 50-Int. A/50-Int. U | 1 | 2 | 90 | 2 | 70 | 2 | 80 |
| C-85 | 80 | 20 | 50-Int. B/50-Int. S | 1 | 4 | 90 | 2 | 70 | 2 | 80 |
| C-86 | 80 | 20 | 50-Int. B/50-Int. T | 2 | 3 | 100 | 2 | 80 | 3 | 80 |
| C-87 | 80 | 20 | 50-Int. B/50-Int. U | 1 | 2 | 90 | 2 | 80 | 2 | 80 |
| 9 | 70 | 30 | 33-Int. A/67-Int. B | 2 | 5 | 100 | 4 | 90 | 5 | 90 |
| Fluorochemical: Intermediate E | | | | | | | | | | |
| C-88 | 100 | — | — | 2 | 2 | 100 | 2 | 80 | 1 | 70 |
| C-89 | 80 | 20 | 100-Int. A | 2 | 2 | 100 | 3 | 90 | 2 | 90 |
| C-90 | 80 | 20 | 100-Int. B | 3 | 4 | 100 | 3 | 90 | 3 | 90 |
| 10 | 80 | 20 | 50-Int. A/50-Int. B | 5 | 4 | 100 | 4 | 100 | 3 | 100 |
| C-91 | 80 | 20 | 50-Int. A/50-Int. R | 2 | 1 | 100 | 1 | 80 | 1 | 70 |
| C-92 | 80 | 20 | 50-Int. A/50-Int. S | 2 | 2 | 100 | 1 | 90 | 1 | 80 |
| C-93 | 80 | 20 | 50-Int. A/50-Int. T | 2 | 1 | 100 | 2 | 90 | 2 | 90 |
| C-94 | 80 | 20 | 50-Int. A/50-Int. U | 2 | 1 | 100 | 1 | 80 | 0 | 80 |
| C-95 | 80 | 20 | 50-Int. B/50-Int. R | 2 | 2 | 100 | 1 | 90 | 0 | 90 |
| C-96 | 80 | 20 | 50-Int. B/50-Int. S | 3 | 2 | 100 | 1 | 90 | 1 | 90 |
| C-97 | 80 | 20 | 50-Int. B/50-Int. T | 1 | 1 | 100 | 1 | 90 | 1 | 90 |
| C-98 | 80 | 20 | 50-Int. B/50-Int. U | 2 | 1 | 100 | 2 | 80 | 0 | 80 |

Blends of Intermediates A and B, when used in accordance with the invention, outperform blends of either Intermediate A or Intermediate B with other commonly used extenders (Intermediates R, S, T and U) in providing fabric with oil and water repellency and spray resistance, both before and after cleaning.

EXAMPLES 11 TO 18 AND COMPARATIVE EXAMPLES C-99 TO C-107

Fluorochemical Intermediate E was evaluated with various combinations of four different copolymer extenders and four different blocked isocyanate extenders as treatments for polyester/cotton 50/50 (at 0.4% solids on fabric). Results of these evaluations are presented in Table IV.

TABLE IV

| | Percent | | Extender Blend (%) 1st Intermed./ | Initial | | 5 Laund. | | 1 Dry Cl. | |
|---|---|---|---|---|---|---|---|---|---|
| Ex. | FC | Ext | 2nd Intermed. | OR | SR | OR | SR | OR | SR |
| C-99 | 100 | 0 | — | 2 | 100 | 2 | 80 | 1 | 70 |
| 11 | 80 | 20 | 50-Int. A/ 50-Int. B | 4 | 100 | 4 | 100 | 3 | 100 |
| C-100 | 80 | 20 | 100-Intermediate A | 2 | 100 | 3 | 90 | 2 | 90 |
| C-101 | 80 | 20 | 100-Intermediate B | 4 | 100 | 3 | 90 | 3 | 90 |
| 12 | 80 | 20 | 50-Int. A/ 50-Int. B2 | 4 | 100 | 4 | 100 | 3 | 100 |
| C-100 | 80 | 20 | 100-Intermediate A | 2 | 100 | 3 | 90 | 2 | 90 |
| C-102 | 80 | 20 | 100-Intermediate B2 | 3 | 100 | 3 | 90 | 3 | 80 |
| 13 | 80 | 20 | 50-Int. A/ 50-Int. B3 | 4 | 100 | 3 | 100 | 3 | 100 |
| C-100 | 80 | 20 | 100-Intermediate A | 2 | 100 | 3 | 90 | 2 | 90 |
| C-103 | 80 | 20 | 100-Intermediate B3 | 3 | 100 | 2 | 90 | 2 | 90 |
| 14 | 80 | 20 | 50 Int. A/ 50-Int. B4 | 4 | 100 | 4 | 100 | 3 | 90 |
| C-100 | 80 | 20 | 100-Intermediate A | 2 | 100 | 3 | 90 | 2 | 90 |
| C-104 | 80 | 20 | 100-Intermediate B4 | 3 | 100 | 3 | 90 | 3 | 80 |
| 15 | 80 | 20 | 50-Int. A2/ 50-Int. B | 4 | 100 | 3 | 100 | 3 | 100 |
| C-105 | 80 | 20 | 100-Intermediate A2 | 1 | 100 | 1 | 80 | 1 | 80 |
| C-101 | 80 | 20 | 100-Intermediate B | 4 | 100 | 3 | 90 | 3 | 90 |
| 16 | 80 | 20 | 50-Int. A3/ 50-Int. B | 4 | 100 | 4 | 100 | 3 | 100 |
| C-106 | 80 | 20 | 100-Intermediate A3 | 2 | 100 | 2 | 80 | 2 | 90 |
| C-101 | 80 | 20 | 100-Intermediate B | 4 | 100 | 3 | 90 | 3 | 90 |
| 17 | 80 | 20 | 50-Int. A4/ 50-Int. B | 4 | 100 | 4 | 100 | 3 | 90 |
| C-107 | 80 | 20 | 100-Intermediate A4 | 2 | 100 | 1 | 80 | 1 | 90 |
| C-101 | 80 | 20 | 100-Intermediate B | 4 | 100 | 3 | 90 | 3 | 90 |
| 18 | 80 | 20 | 50-Int. A3/ 50-Int. B2 | 4 | 100 | 3 | 100 | 3 | 100 |
| C-106 | 80 | 20 | 100-Intermediate A3 | 2 | 100 | 2 | 80 | 2 | 90 |
| C-102 | 80 | 20 | 100-Intermediate B2 | 3 | 100 | 3 | 90 | 3 | 80 |

The data in Table IV show that spray ratings (SR) after laundering or dry cleaning are generally superior using the extender combinations when compared to each extender used alone.

EXAMPLES 19 TO 23 AND COMPARATIVE EXAMPLES C-108 TO C-114

Fluorochemical Intermediate F was evaluated with various combinations of four different copolymer extenders and four different blocked isocyanate extenders as treatments for polyester/cotton 50/50 (at 0.4% solids on fabric). Results of these evaluations are presented in Table V.

TABLE V

| | Percent | | Extender Blend (%) 1st Intermed./ | Initial | | 5 Laund. | | 1 Dry Cl. | |
|---|---|---|---|---|---|---|---|---|---|
| Ex. | FC | Ext | 2nd Intermed. | OR | SR | OR | SR | OR | SR |
| C-108 | 100 | 0 | — | 5 | 100 | 4 | 60 | 5 | 80 |
| 19 | 80 | 20 | 50-Int. A/ 50-Int. B | 6 | 100 | 5 | 100 | 6 | 90 |
| C-109 | 80 | 20 | 100-Intermediate A | 5 | 100 | 4 | 90 | 4 | 80 |
| C-110 | 80 | 20 | 100-Intermediate B | 5 | 100 | 4 | 70 | 4 | 70 |
| 20 | 80 | 20 | 50-Int. A/ 50-Int. B | 5 | 100 | 5 | 100 | 5 | 90 |
| C-109 | 80 | 20 | 100-Intermediate A | 5 | 100 | 4 | 90 | 4 | 80 |
| C-111 | 80 | 20 | 100-Intermediate B2 | 5 | 100 | 4 | 80 | 4 | 60 |
| 21 | 80 | 20 | 50-Int. A 50-Int. B4 | 5 | 100 | 5 | 100 | 5 | 90 |
| C-109 | 80 | 20 | 100-Intermediate A | 5 | 100 | 4 | 90 | 4 | 80 |
| C-112 | 80 | 20 | 100-Intermediate B4 | 5 | 100 | 4 | 80 | 4 | 70 |
| 22 | 80 | 20 | 50-Int. A3/ 50-Int. B | 5 | 100 | 5 | 100 | 4 | 90 |
| C-113 | 80 | 20 | 100-Intermediate A3 | 5 | 100 | 4 | 80 | 4 | 80 |
| C-110 | 80 | 20 | 100-Intermediate B | 5 | 100 | 4 | 70 | 4 | 70 |
| 23 | 80 | 20 | 50-Int. A4/ 50-Int. B | 5 | 100 | 4 | 100 | 4 | 90 |
| C-114 | 80 | 20 | 100-Intermediate A4 | 4 | 100 | 3 | 80 | 3 | 80 |
| C-110 | 80 | 20 | 100-Intermediate B | 5 | 100 | 4 | 70 | 4 | 70 |

The data in Table V show that spray ratings (SR) after laundering or dry cleaning are generally superior using the extender combinations when compared to each extender used alone.

Various modifications and alterations of this invention will become apparent to those skilled in the art without departing from the scope and spirit of this invention. It should be understood that this invention is not to be unduly limited to the embodiments set forth herein.

The claimed invention is:

1. A fibrous substrate having high initial water repellency and laundry-durable water repellency comprising a fibrous material and a treatment, wherein the treatment is applied to the substrate at an amount of no more than about 0.4 weight percent, based on the weight of the substrate without treatment, and the treatment of a composition comprises:

(A) a fluorochemical oil- and water-repellent agent selected from the group consisting of $R_f$-containing polyisocyanates with one or more blocked isocyanate groups, $R_f$-containing carbodiimides, $R_f$-containing melamines, and copolymers of fluorochemical acrylates or methacrylates with copolymerizable, fluorine-containing or hydrophobic, fluorine-free comonomers;

(B) a copolymer extender comprising:

(i) polymerized units derived from a monomer of formula:

$CR_1R_2{=}CR_3R_4$ wherein each of $R_1$, $R_2$, $R_3$, and $R_4$ independently represents hydrogen, halogen, or an organic group; and (ii) polymerized units derived from a monomer of formula:

$CH_2{=}CR_5X$ wherein $R_5$ represents a hydrogen atom or a methyl group, and X represents a moiety comprising a functional group that can interact with a fibrous substrate; and (C) a blocked isocyanate extender.

2. A substrate according to claim 1, wherein the copolymer extender comprises:

(i) polymerized units derived from a monomer of the formula:

$CR_6R_7{=}CR_8COOR_9$ wherein $R_6$, $R_7$, and $R_8$ independently represent a hydrogen atom or a methyl groups, and $R_9$ represents a $C_{1-18}$ alkyl group; and (ii) polymerized units derived from a monomer of the formula:

$CH_2{=}CR_5CONHCH_2OH$ wherein $R_5$ represents a hydrogen atom or a methyl group.

3. A substrate according to claim 2, wherein the copolymer extender comprises:

(i) polymerized units derived from a monomer selected from the group consisting of an alkyl crotonate, an alkyl acrylate, and an alkyl methacrylate; and (ii) polymerized units derived from a monomer of the formula:

$CH_2{=}CR_5CONHCH_2OH$ wherein $R_5$ represents a hydrogen atom or a methyl group.

4. A substrate according to claim 1, wherein the blocked isocyanate extender is a blocked isocyanate-functional, low molecular weight polyurethane.

5. A substrate according to claim 1, wherein the blocked isocyanate extender is a blocked aromatic isocyanate.

6. A substrate according to claim 1, wherein the blocked isocyanate extender is polyphenylpolyisocyanate blocked with 2-butanone oxime.

7. A substrate according to claim 1, wherein the extenders are present in relative amounts of about 1:1.

8. A substrate according to claim 1, wherein the substrate is selected from the groups consisting of paper, non-woven, cotton, a polyester/cotton blend, nylon, and leather.

9. A substrate according to claim 1, wherein the fluorochemical agent is a copolymer of a fluorochemical acrylate or methacrylate with one or more copolymerizable fluorine-containing or hydrophobic, fluorine-free comonomers.

10. A substrate according to claim 1, wherein the comonomers are selected from the group consisting of: methyl methacrylate, butyl acrylate, octadecylmethacrylate glycidyl methacrylate, ethylene, vinyl acetate, vinyl chloride, vinylidene chloride, acrylonitrile, vinyl chloroacetate, isoprene, chloroprene, styrene, butadiene, vinylpyridine, vinyl alkyl ethers, vinyl alkyl ketones, N-methylacrylamide, and vinylidene fluoride.

11. A substrate according to claim 1, wherein the fluorochemical agent is a $R_f$-containing polyisocyanate with one or more blocked isocyanate groups.

12. A substrate according to claim 1, wherein the fluorochemical agent is a $R_f$-containing carbodiimide.

* * * * *

UNITED STATES PATENT AND TRADEMARK OFFICE

CERTIFICATE OF CORRECTION

PATENT NO. : 6,309,752 B1
DATED : October 30, 2001
INVENTOR(S) : Dams, Rudolf J.

It is certified that error appears in the above-identified patent and that said Letters Patent is hereby corrected as shown below:

Column 1,
Line 39, "$CR_1R_2=CR_3R_4$" should read -- $CR_1R_2=CR_3COOR_4$ --;
Line 46, "group" should read -- group. --;

Column 3,
Line 1, "poly)oxyalkylene)" should read -- poly(oxyalkylene) --;
Line 66, "$F_f$-containing" should read -- $R_f$-containing --;

Column 4,
Line 20, "12)" should read -- 12). --;
Line 36, "function" should read -- functional --;

Column 5,
Line 26, "NO." should read -- No. --;

Column 7,
Line 42, "ot" should read -- to --;

Column 9,
Line 60, "place din" should read -- placed in --;

Column 11,
Line 33, "Japan]0.12 g," should read -- Japan] 0.12 g, --;
Line 63, "describe din" should read -- described in --; and Column 13,
Line 4, "Them mixture" should read -- The mixture --.

Signed and Sealed this

Twenty-second Day of October, 2002

*Attest:*

*Attesting Officer*

JAMES E. ROGAN
*Director of the United States Patent and Trademark Office*